US010265571B2

(12) United States Patent
Ban

(10) Patent No.: US 10,265,571 B2
(45) Date of Patent: Apr. 23, 2019

(54) STRETCHING MAT

(71) Applicant: NCC CO., LTD., Aichi (JP)

(72) Inventor: Toshiki Ban, Aichi (JP)

(73) Assignee: NCC Co., Ltd., Aichi (JP)

( * ) Notice: Subject to any disclaimer, the term of this patent is extended or adjusted under 35 U.S.C. 154(b) by 304 days.

(21) Appl. No.: 15/028,921

(22) PCT Filed: Nov. 20, 2013

(86) PCT No.: PCT/JP2013/081254
§ 371 (c)(1),
(2) Date: Apr. 12, 2016

(87) PCT Pub. No.: WO2015/056359
PCT Pub. Date: Apr. 23, 2015

(65) Prior Publication Data

US 2016/0243395 A1 Aug. 25, 2016

(30) Foreign Application Priority Data

Oct. 14, 2013 (JP) ..... 2013-214300

(51) Int. Cl.
*A63B 21/00* (2006.01)
*A61H 1/02* (2006.01)
(Continued)

(52) U.S. Cl.
CPC ..... *A63B 21/4037* (2015.10); *A61H 1/0292* (2013.01); *A61H 9/0078* (2013.01);
(Continued)

(58) Field of Classification Search
CPC ..... A47G 9/1027; A63B 21/4037; A63B 21/00047; A47C 7/46; B60N 2/66
See application file for complete search history.

(56) References Cited

U.S. PATENT DOCUMENTS 4,805,603 A * 2/1989 Cumberland ..... A47G 9/1027 128/DIG. 20
5,243,721 A * 9/1993 Teasdale ..... A61G 7/05776 5/710

(Continued)

FOREIGN PATENT DOCUMENTS

JP 2008-073185 A 4/2008
JP 2012-016396 A 1/2012

OTHER PUBLICATIONS

International Search Report issued in corresponding Application No. PCT/JP2013/081254, dated Feb. 10, 2014.

(Continued)

*Primary Examiner* — Eric J Kurilla
(74) *Attorney, Agent, or Firm* — McDermott Will & Emery LLP

(57) ABSTRACT

Provided is a stretching mat whereby high stretching effects are obtained relative to the conventional configuration. An air bag is provided to a stretching part for curving and protruding in a ridge shape along a front-rear direction, and transformation is possible between a gently curved state in which the air bag is deflated and a strongly curved state in which the airbag is swollen and more strongly curved than in the gently curved state. A configuration is also adopted in which air is supplied to the air bag in a state in which a portion of a body is resting on the stretching part, and the stretching part transforms from the gently curved state to the strongly curved state over time, after which the supply of air is stopped and the strongly curved state of the stretching part is maintained.

6 Claims, 7 Drawing Sheets

(51) Int. Cl.
*A61H 9/00* (2006.01)
*A61H 23/02* (2006.01)

(52) U.S. Cl.
CPC . *A61H 23/0254* (2013.01); *A61H 2201/0134* (2013.01); *A61H 2201/0157* (2013.01)

(56) References Cited

U.S. PATENT DOCUMENTS

| | | | | |
|---|---|---|---|---|
| 5,771,514 | A * | 6/1998 | Wilhoit | A47G 9/1027 5/421 |
| 6,951,038 | B1 * | 10/2005 | Ganoe, Sr. | A47G 9/1027 5/636 |
| 2006/0014613 | A1 | 1/2006 | Van Straaten et al. | |
| 2012/0040810 | A1 * | 2/2012 | Astilla | A63B 21/00047 482/131 |
| 2015/0366368 | A1 * | 12/2015 | Cheng | A47C 27/081 5/644 |

OTHER PUBLICATIONS

International Preliminary Report on Patentability which issued in corresponding Application No. PCT/JP2013/081254, dated Nov. 4, 2015.

* cited by examiner

4A

4B

5A

5B

6A

6B

7A

7B

STRETCHING MAT

CROSS REFERENCE

This application is the U.S. National Phase under 35 US.C. § 371 of International Application No. PCT/JP2013/081254, filed on Nov. 20, 2013, which claims the benefit of Japanese Application No. 2013-214300, filed on Oct. 14, 2013, the entire contents of each are hereby incorporated by reference.

TECHNICAL FIELD

The present invention relates to a stretching mat whereby stretching effects are obtained when a portion of a body is placed thereon.

BACKGROUND ART

A stretching mat provided with a stretching part that curves and protrudes in a ridge shape along a front-rear direction at an upper part of a housing is known (for example, Patent Literature 1). With such a stretching mat, when one lies down on the stretching mat face-up such that one's back, hip, neck, and the like are placed on the stretching part, muscles of the portions placed on the stretching part will be stretched, and thus stretching effects can be obtained. In addition, the stretching mat according to Patent Literature 1 includes vibration means inside the housing, and is configured to enhance the stretching effects by vibrating the stretching part in a state where a body is placed thereon.

RELATED ART DOCUMENT

Patent Literature

Patent Literature 1: Japanese Patent Application Publication No. 2012-16396 (JP 2012-16396 A)

SUMMARY OF INVENTION

Problems to be Solved by the Invention

Incidentally, in doing stretching exercises, it is considered ideal to slowly stretch a target portion in a state where the muscles are relaxed, and then hold that posture with the target portion being stretched for a certain period of time. However, with the above-described conventional stretching mat, while it is possible to hold the posture with the portion of the body placed on the stretching part being stretched when the body is placed on the stretching part, it is difficult to slowly lie down on the curved stretching part face-up in a relaxed manner, and thus it is difficult to slowly stretch the portion placed on the stretching part in a state where the muscles are relaxed. In other words, conventional stretching mats have not realized the operation that provides an ideal movement in the stretching exercise, and thus leaving room for improvement of the stretching effects.

The present invention has been made in view of such circumstances, and therefore the purpose of the present invention is to provide a stretching mat whereby higher stretching effects are obtained compared to the conventional configuration.

Means for Solving the Problem

The present invention relates to a stretching mat including a stretching part, at an upper part of a housing, that curves and protrudes in a ridge shape along a front-rear direction for placing a portion of a body thereon to stretch the body, wherein the stretching part is provided with an air bag placed on the housing and is transformable between a gently curved state in which the air bag is deflated and a strongly curved state in which the air bag is swollen and more strongly curved than in the gently curved state, air-supply means that supplies air to the air bag, exhaust means that exhausts air from the air bag, and air control means that controls operation of the air-supply means and the exhaust means are disposed inside the housing, and the air control means executes stretching control processing by supplying air to the air bag of the stretching part in the gently curved state by the air-supply means and transforming the stretching part from the gently curved state to the strongly curved state over time, then stopping supply of the air by the air-supply means to maintain the strongly curved state of the stretching part. Here, during the stretching control processing, the duration for transforming the stretching part from the gently curved state to the strongly curved state is preferably 5 seconds or more.

In such a configuration, because the curvature of the stretching part is small in the gently curved state, the user can place one's body on the stretching part without having to stretch oneself excessively. At this time, by using the gentle curvature of the stretching part, the user can accurately locate the body as one wishes on the stretching part. Further, in the present invention, when the stretching control processing is executed in the state where the body is placed on the stretching part in the gently curved state, the stretching part transforms into the strongly curved state over time, the curvature of the stretching part becoming larger gradually. Accordingly, the body of the user stretches slowly. In addition, at this time, the user only needs to place one's body on the stretching part, which makes it possible to fully stretch the muscles in a sufficiently relaxed state. Further, the stretching part maintains the strongly curved state after the stretching part is transformed into the strongly curved state. Accordingly, the portion of the body stretched by the stretching part is retained in the stretched state. As described above, according to the stretching mat of the present invention, higher stretching effects can be obtained compared to the conventional configuration because movements necessary for stretching exercises, such as slowly stretching the body and then holding in the stretched state, can be realized by executing the stretching control processing with the body placed on the stretching part.

In the present invention, it is suggested that the air control means may maintain the strongly curved state of the stretching part for a predetermined time, then exhaust the air in the air bag by the exhaust means, and transform the stretching part from the strongly curved state to the gently curved state, during the stretching control processing.

In such a configuration, when the stretching control processing is executed, the stretching part returns to the gently curved state after the stretching part is maintained in a strongly curved state for a predetermined time. Thus the user can take away the stretched portion, which had been stretched in the strongly curved state, from the stretching part after relaxing the stretched portion to some extent. As a result, the user does not need to take away one's body from the stretching part in an uncomfortable state with the body strongly stretched.

Further, in the present invention, it is suggested that an operation switch disposed on a side surface of the housing and that causes the air control means to initiate the stretching control processing may be provided, and the air control means may initiate the stretching control processing after a predetermined time has elapsed from an operation for initiating the stretching control processing is executed by the operation switch.

In such a configuration, the stretching part is maintained in a gently curved state for a predetermined time even after the operation switch is operated. Accordingly, the user does not have to strain oneself to turn on the operation switch in a state where the body is placed on the stretching part, if one places one's body on the stretching part during the predetermined time. Note that the "predetermined time" is set preferably between 5 seconds and 60 seconds. If this predetermined time is shorter than 5 seconds, the user has to place one's body in haste on the stretching part. If the predetermined time is longer than 60 seconds, a standby time until the stretching control processing is initiated becomes undesirably long.

Further, in the present invention, it is suggested that the air control means may control a volume of air to be supplied to the air bag by air-supply means during the stretching control processing to make possible control of a plurality of strongly curved states of the stretching part at different degrees of curvature.

In such a configuration, the degree of curvature of the stretching part in the strongly curved state can be adjusted in a plurality of stages, and thus an adequate stretching intensity appropriate for the stiffness of the body of the user can be realized.

In addition, in the present invention, it is suggested that at least one of front and rear parts of the stretching part on an upper surface of the housing may be provided with a retaining part for placing a portion of a body, aside from a portion to be placed on the stretching part, thereon to allow a position of the body to be retained, vibration means for vibrating the housing and vibration control means for controlling an operation of the vibration means may be disposed inside the housing, and the vibration control means may actuate the vibration means during the stretching control processing.

In such a configuration, the stretching effects can be further improved by transmitting the vibration of the housing to the body of the user via the retaining part during the stretching control processing.

Advantageous Effects of Invention

As described above, higher stretching effects can be obtained compared to the conventional configuration, because the ideal movement in the stretching exercise is made possible with the stretching mat according to the present invention.

EMBODIMENT OF THE INVENTION

An embodiment of the present invention will now be described in detail with reference to the accompanying drawings.

Figure 1:
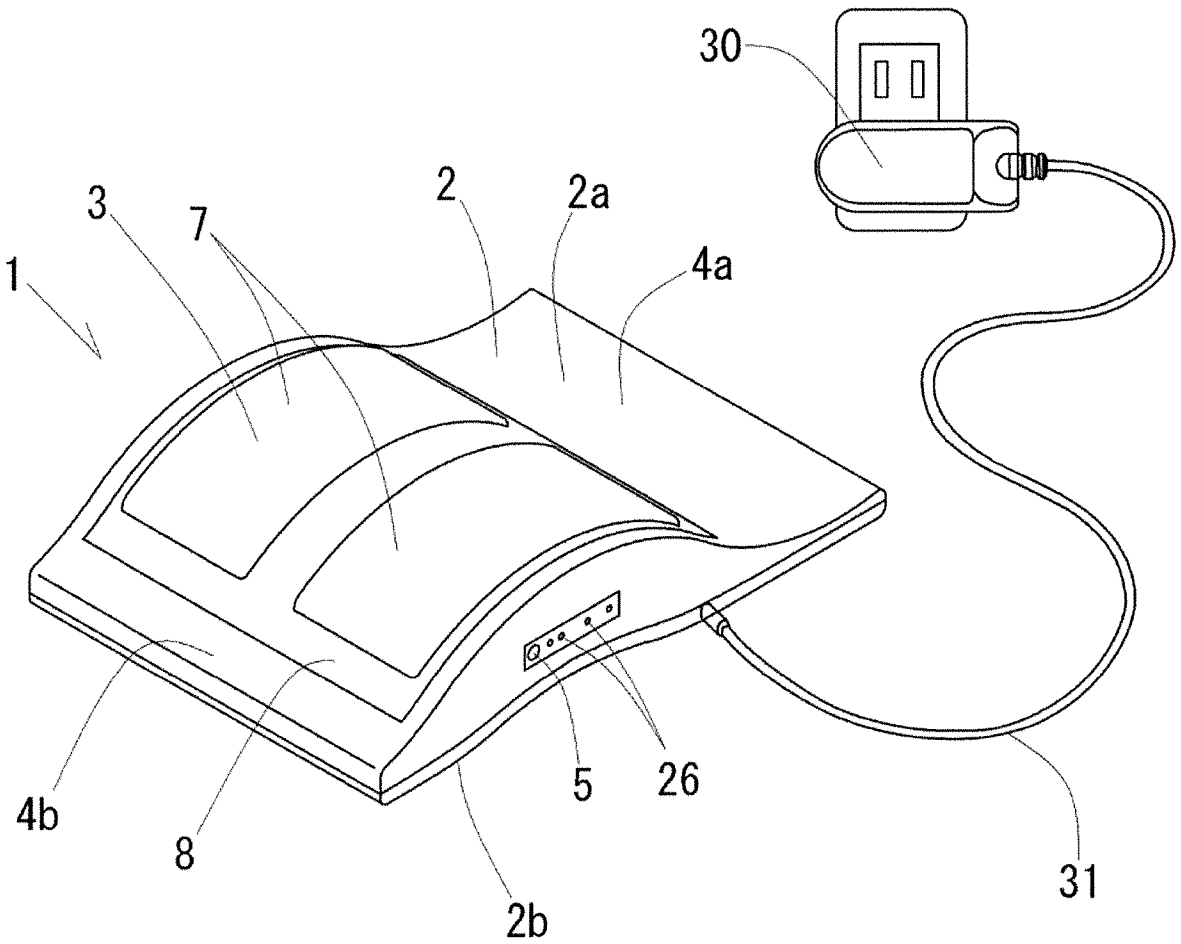
FIG. 1 is a schematic view of a stretching mat 1 of the present embodiment.
Figure 2:
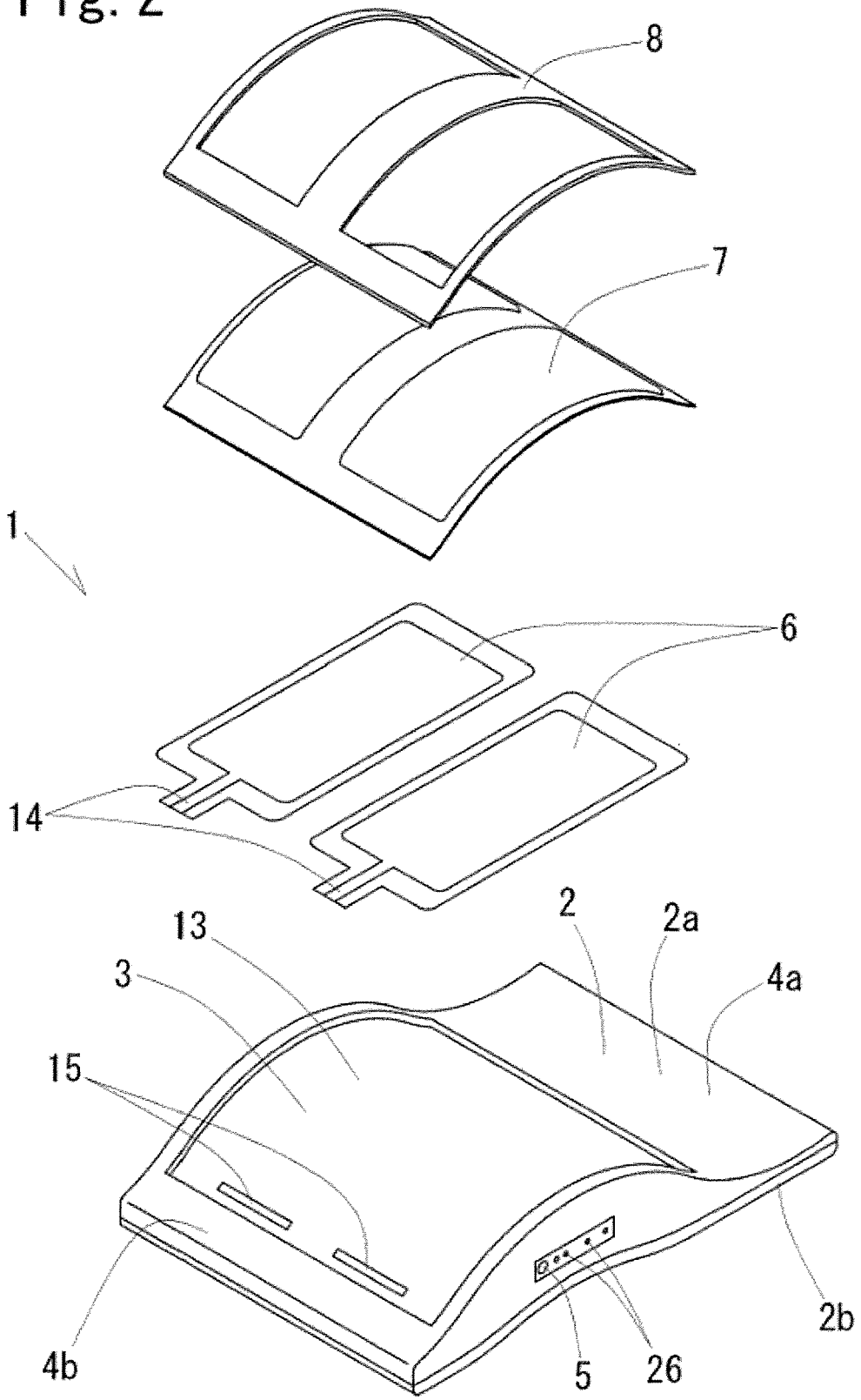
FIG. 2 is a perspective view of the stretching mat 1 shown in a state where air bags 6 and the like are separated therefrom.
Figure 3:
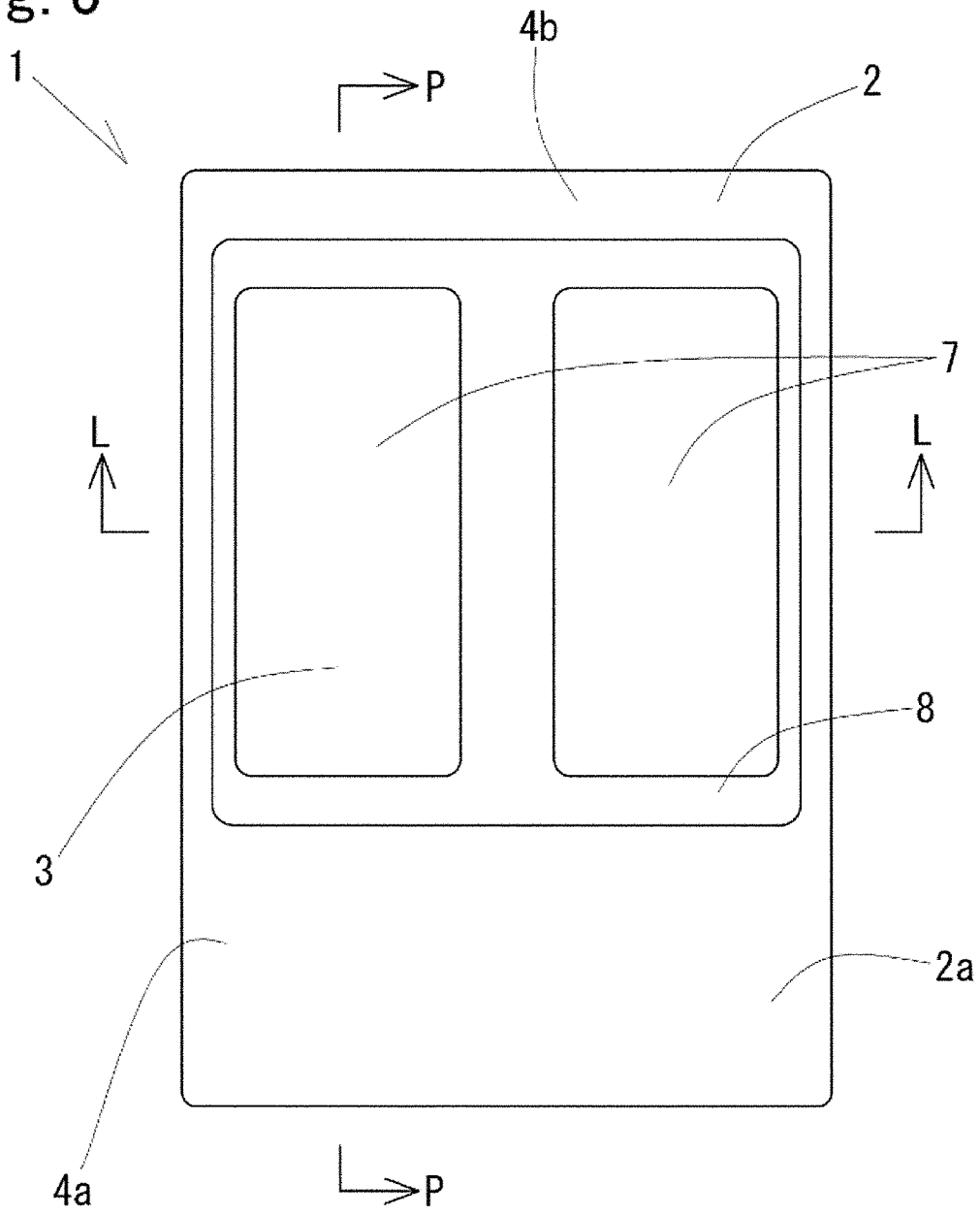
FIG. 3 is a plan view of the stretching mat 1.
Figure 4:
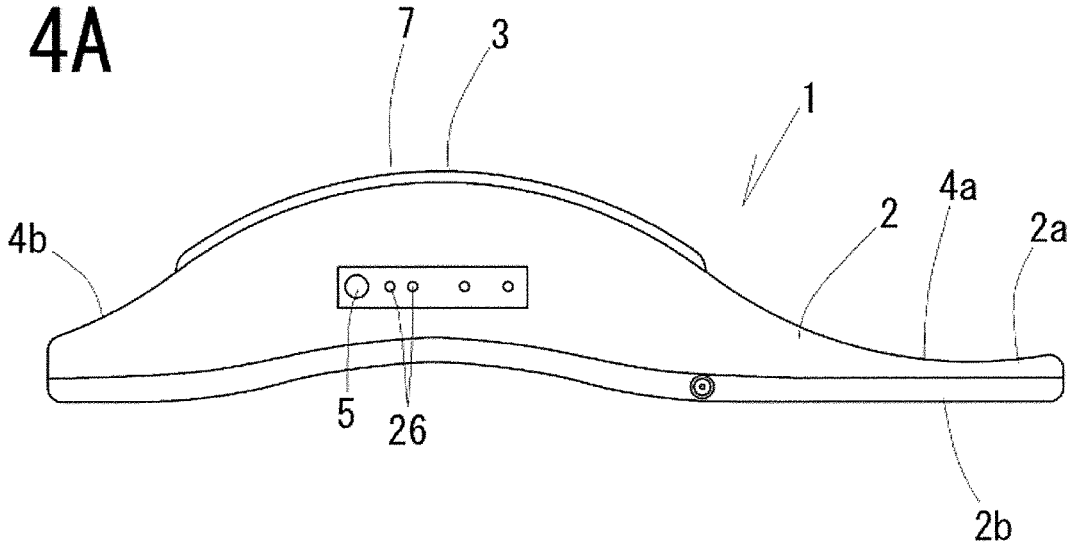
FIG. 4A and FIG. 4B are side views of the stretching mat 1, FIG. 4A illustrating a gently curved state of a stretching part 3, and FIG. 4B illustrating a strongly curved state of the stretching part 3.
Figure 4:
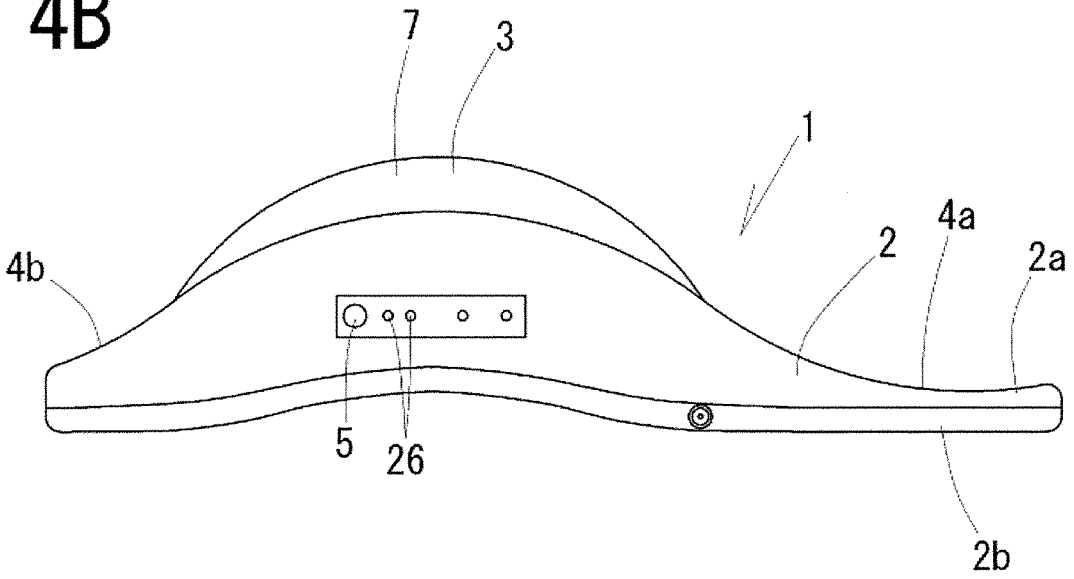
Figure 5:
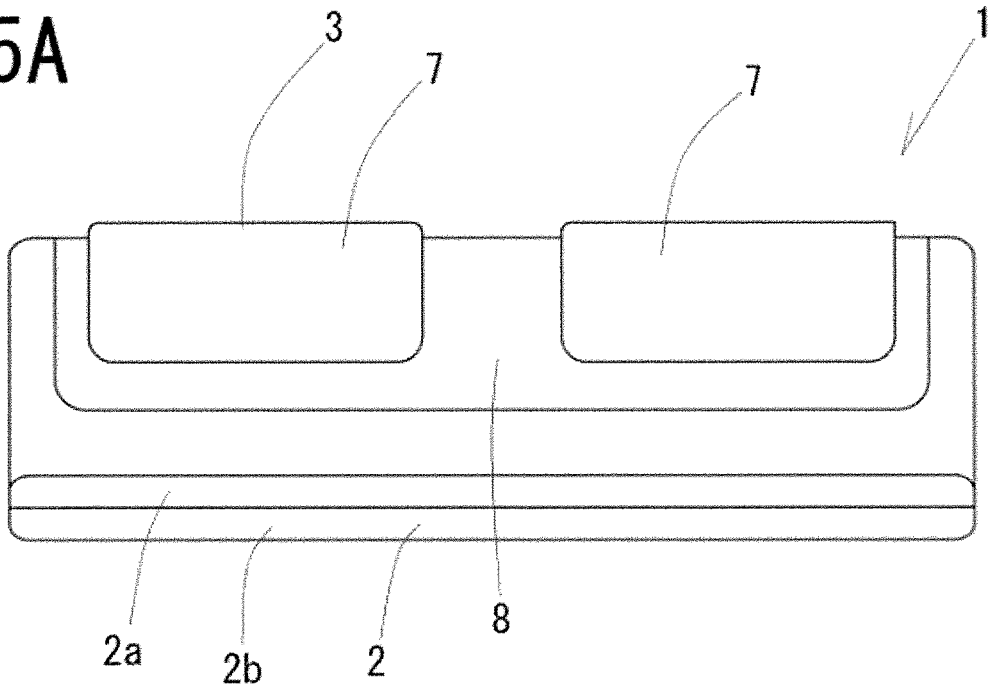
FIG. 5A and FIG. 5B are front views of the stretching mat 1, FIG. 5A illustrating the gently curved state of the stretching part 3, and FIG. 5B illustrating the strongly curved state of the stretching part 3.
Figure 5:
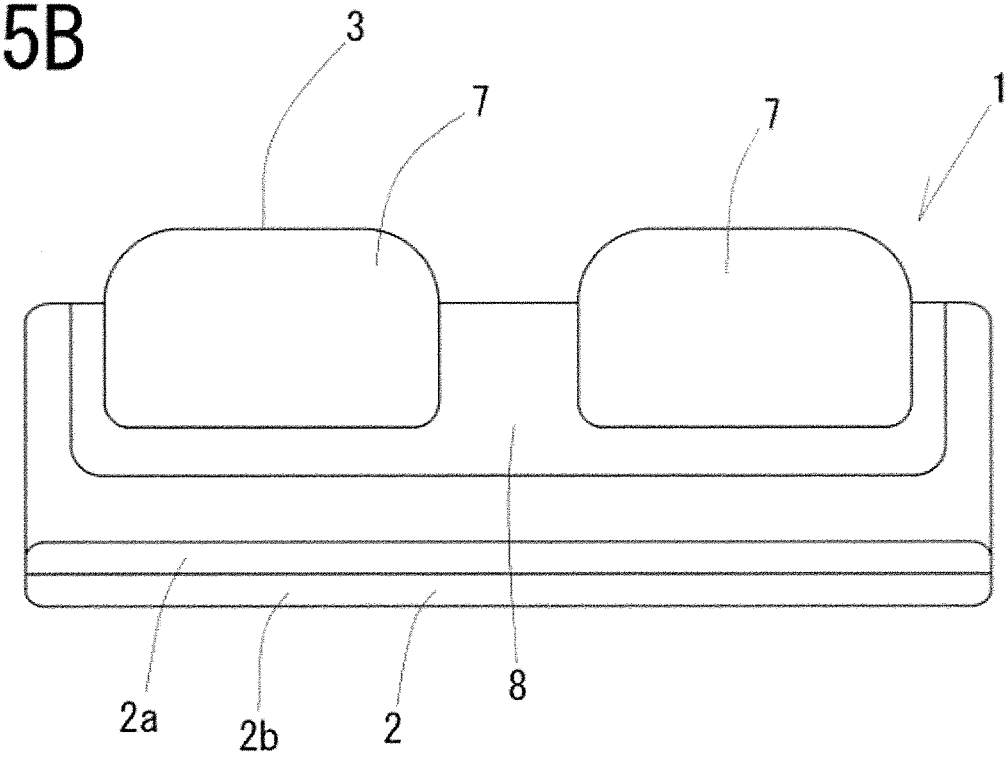

As shown in FIGS. 1 to 3, a stretching mat 1 of the present embodiment is provided with a stretching part 3 that curves and protrudes in a ridge shape along a front-rear direction at an upper part of a housing 2. Note that, in the present embodiment, a vertical direction in FIG. 3 corresponds to the front-rear direction and a horizontal direction in FIG. 3 corresponds to a width direction of the stretching mat 1. Normally, this stretching mat 1 is used by lying oneself thereon face-up such that the centerline of the body matches the front-rear direction of the stretching mat 1.

The stretching mat 1 is connected to an external power supply 30 via a dedicated power supply cord 31. Electrical power of the external power supply 30 is supplied to an air pump 17, a vibration motor 18, a control board 19, and the like described later. In addition, an operating switch 5 used for switching the power supply between ON and OFF or switching operating modes is disposed on a side surface of the stretching mat 1.

An upper part of the housing 2 is provided with the stretching part 3 that curves and protrudes in a ridge shape along a front-rear direction and retaining parts 4*a*, 4*b* that are disposed on a closer side and a further side of the stretching part 3, respectively. The retaining parts 4*a*, 4*b* are for placing portions of the body other than those placed on the stretching part 3 to be stretched thereon so as to allow a position of the body to be retained when using the stretching mat 1. For example, when stretching the back, the back is placed on the stretching part 3 while the hip is placed on the retaining part 4*a* to allow the position of the body to be retained. Further, when stretching the neck, the neck is placed on the stretching part 3 while the head and the shoulders are placed on the retaining parts 4*a*, 4*b* to allow the position of the body to be retained.

As shown in FIG. 2, on the upper part of the housing 2, two air bags 6, 6 are disposed at a part forming the stretching part 3. To be more specific, a recessed part 13 which is slightly recessed with respect to a periphery thereof is formed at the part forming the stretching part 3 on the upper part of the housing 2. The two air bags 6 are placed at a bottom part of the recessed part 13 at symmetrical positions.

As shown in FIG. 2, the air bag 6 is a hollow bag formed by joining a periphery of two resin sheets. A vent 14 for supplying/exhausting air is open on an end part of the air bag 6. As shown in FIG. 6B, the vent 14 of the air bag 6 is inserted into an interior gap 9 of the housing 2 from a slit 15 formed at an edge of the recessed part 13 of the housing 2.

As shown in FIG. 2, a cover sheet 7 is disposed on the air bag 6 so as to cover the air bag 6. The cover sheet 7 is a stretchable and flexible sheet that stretches in response to swelling of the air bag 6. A presser plate 8 is disposed on the air bag 6 and the cover sheet 7. The presser plate 8 fixes the air bag 6 and the cover sheet 7 to an upper surface of the housing 2 by being arranged so as to press an outer peripheral part of the air bag 6 from above and being fixed to the housing 2 by screws (not shown).

In such a structure, as shown in FIGS. 4A, 5A, 6A, and 7A, in a state where air is released from the vent 14 and the air bag 6 is deflated and flat, the stretching part 3 is in a gently curved state of a shape similar to the curved shape of the upper surface of the housing 2. On the other hand, as shown in FIGS. 4B, 5B, 6B, and 7B, in a state where the air flows in via the vent 14 to inflate the air bag 6 in a thickness direction, the stretching part 3 swells upward and results in a strongly curved state which is a state more strongly curved than the curved shape of the upper surface of the housing 2.

Figure 6:
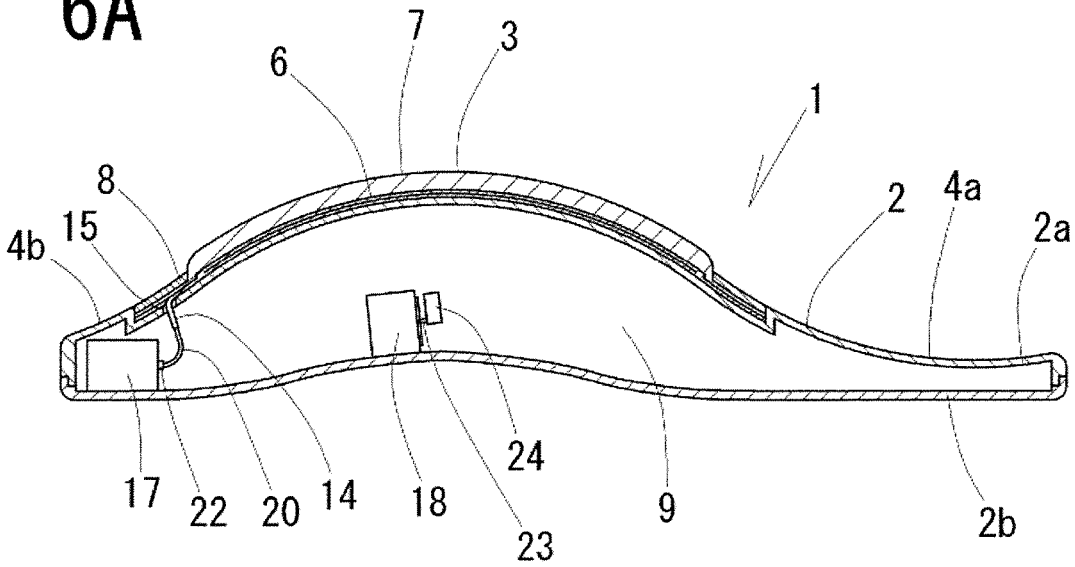
FIG. 6A and FIG. 6B are cross-sectional views taken along a line P-P in FIG. 3, FIG. 6A illustrating the gently curved state of the stretching part 3 and FIG. 6B illustrating the strongly curved state of the stretching part 3.
Figure 6:
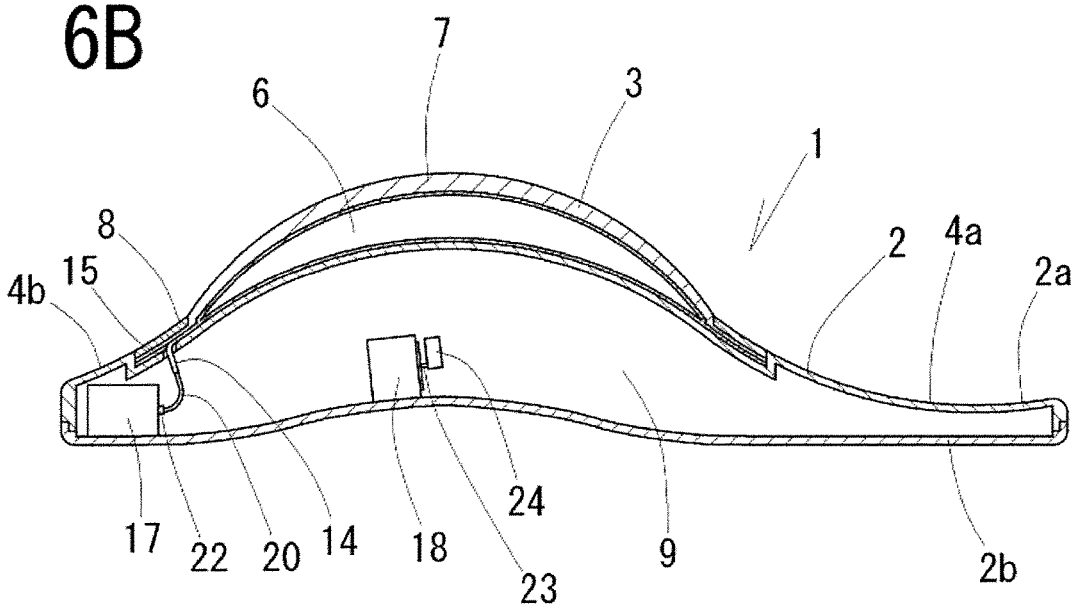
Figure 7:
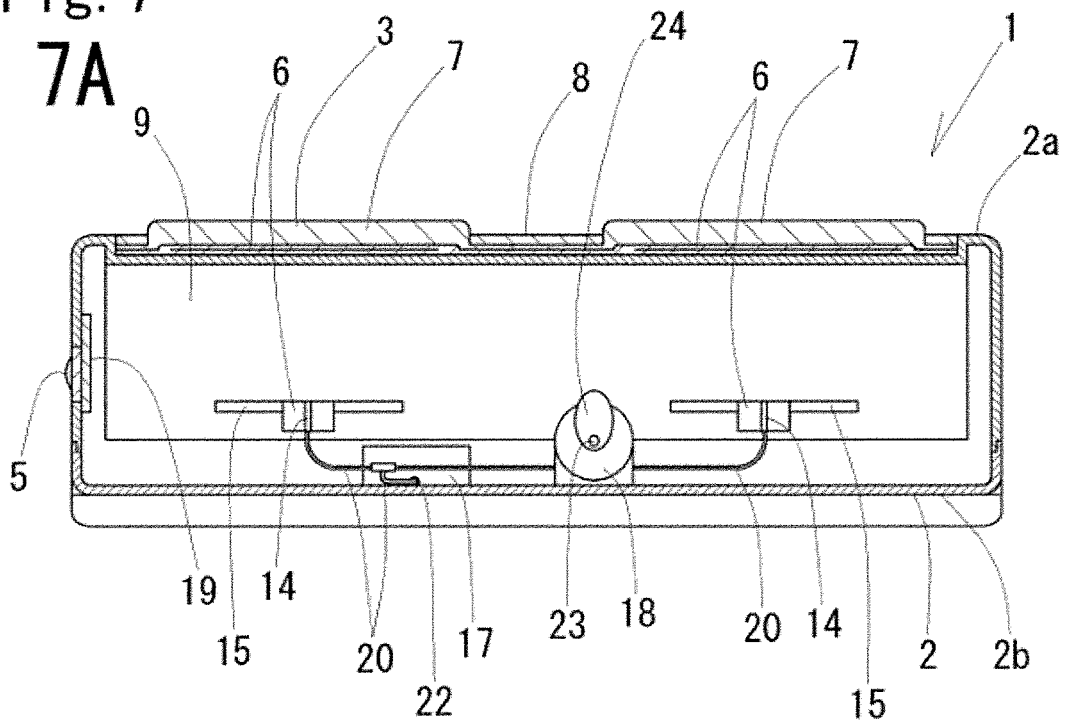
FIG. 7A and FIG. 7B are cross-sectional views taken along a line L-L in FIG. 3, FIG. 7A illustrating the gently curved state of the stretching part 3 and FIG. 7B illustrating the strongly curved state of the stretching part 3.
Figure 7:
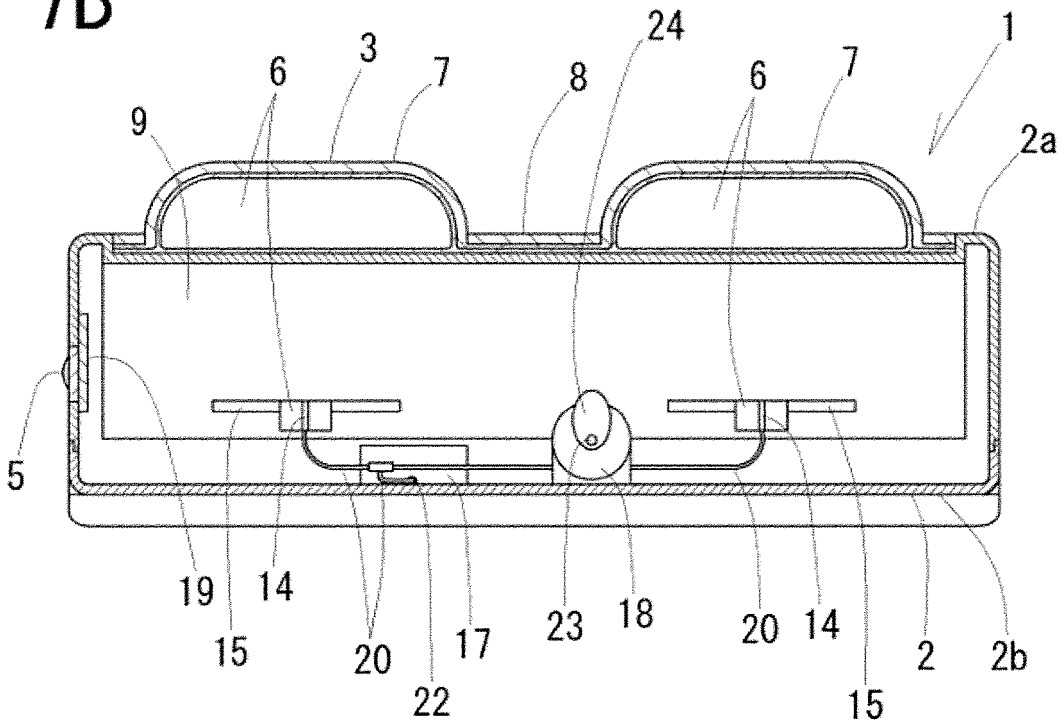

As shown in FIGS. 6 and 7, the housing 2 is formed by integrally joining an upper cover 2*a* that constitutes a top surface and both side surfaces with a base body 2*b* that constitutes a bottom part using a plurality of screws (not shown). An interior gap 9 is formed between the upper cover 2*a* and the base body 2*b*. The upper cover 2*a* and the base body 2*b* are both made of rigid plastic.

As shown in FIGS. 6 and 7, the air pump 17 that supplies air to the air bag 6, the vibration motor 18 that vibrates the housing 2, the control board 19 that controls an operation of the air pump 17 and the vibration motor 18, an air tube 20 that is connected to the air pump 17 and the air bag 6, and a lead wire (not shown) that mutually connects the control board 19, the air pump 17, the vibration motor 18, and the like, are disposed in the interior gap 9 of the housing 2.

The air pump 17 is constituted by a general-purpose air pump capable of supplying/exhausting air, thus constituting air-supply means and exhaust means according to the present invention. To be specific, the air pump 17 is provided with an air-supply/exhaust port 22 capable of supplying/exhausting air. The air-supply/exhaust port 22 communicates with the respective vents 14 of the two air bags 6, 6 via the air tubes 20. The air pump 17 is controlled by the control board 19 to be transformable among an air-supply state in which the air is sent from the air-supply/exhaust port 22 to the air bag 6, an exhaust state in which air in the airbag 6 is exhausted from the air-supply/exhaust port 22, and a closed state in which the air bag 6 is sealed by closing the air-supply/exhaust port 22.

In other words, if the air pump 17 is caused to be in the air-supply state from a state where the air bag 6 is deflated, the air bag can be inflated such that the stretching part 3 is transformed into a strongly curved state. In addition, if the air pump 17 is caused to be in the closed state, the air bag 6 will be sealed. Accordingly, the gently curved state and the strongly curved state of the stretching part 3 can be maintained. Further, if the air pump 17 is caused to be in the exhaust state from a state where the air bag 6 is swollen, the air bag 6 can be deflated such that the stretching part 3 can be transformed into the gently curved state.

The vibration motor 18 is a general-purpose motor having an eccentric weight 24 fixed to a drive shaft 23 thereof. The vibration motor 18 is driven and controlled by the control board 19. The vibration motor 18 is fixed integrally to a base body 2*b*. The vibration motor 18 is configured such that when the vibration motor 18 is driven and the eccentric weight 24 rotates causing the vibration motor 18 to vibrate, the entire housing 2 vibrates. In other words, the vibration motor 18 constitutes the vibration means of the present invention.

The control board 19 is on an interior of the housing 2 and disposed on a back side of the operation switch 5. This control board 19 is for executing operation control of the air pump 17 and the vibration motor 18 on the basis of operation of the operation switch 5. In other words, the control board 19 constitutes the air control means and the vibration control means of the present invention. As described below, the control board 19 executes stretching control processing by controlling the air pump 17 to transform the stretching part 3 from the gently curved state to the strongly curved state and restoring the gently curved state after maintaining the strongly curved state.

The operation switch 5 is a push-button type switch connected to the control board 19 on a reverse side, and is used by a user to turn ON/OFF the power supply and to select operation modes in accordance with a number of depression and a depression duration thereof. In addition, lamps 26 that indicate power supply states and operation modes are disposed beside the operation switch 5. These lamps 26 are respectively connected to the control board 19 on the reverse side such that lighting thereof is controlled by the control board 19.

Next, a method for doing a stretching exercise using the stretching mat 1 of the present embodiment will be described.

As shown in FIG. 1, the stretching mat 1 is placed on the floor, and the power supply cord 31 is connected to the external power supply 30. Then, in this state, if the operation switch 5 is pressed, the power supply turns from OFF to ON. Here, the stretching part 3 is in the gently curved state when the power is turned OFF or during an initial state immediately after the power is turned ON. When the power is turned ON, the control board 19 will be in the operation mode selection state for selecting the operation mode for the stretching control processing. Four operation modes are provided below, namely, "neck" or "back and hip" in accordance with a part of the body being stretched, and "strong" or "weak" in accordance with a stretching intensity. The operation mode being selected is sequentially switched among four types below each time the operation switch 5 is depressed.

1. Neck (strong): supply air for 30 seconds→close for 30 seconds→exhaust air for 15 seconds
2. Back and hip (strong): supply air for 35 seconds→close for 25 seconds→exhaust air for 15 seconds
3. Neck (weak): supply air for 20 seconds→close for 30 seconds→exhaust air for 15 seconds
4. Back and hip (weak): supply air for 25 seconds→close for 25 seconds→exhaust air for 15 seconds When the operation mode is selected and a non-operation state of the operation switch 5 continues for 20 seconds, the control board 19 terminates the operation mode selection state and initiates the stretching control processing in the selected operation mode. Accordingly, in the present embodiment, the portion of the body one wishes to stretch can be placed on the stretching part 3 before the stretching control processing starts by using the 20 seconds after turning on the operation switch 5, so the user does not have to turn on the operation switch 5 while one's body is laid on the stretching part 3.

For example, when the "back and hip (strong)" mode is selected to stretch the back, one first turns ON the power supply and then operates the operation switch 5 to select the operation mode "back and hip (strong)". Then one lies on the stretching mat 1 face-up to place one's back on the stretching part 3. At the same time, one's hip is placed on the retaining part 4*a* to have the body retained thereon.

When the operation mode "back and hip (strong)" is selected by the operation switch 5 and 20 seconds elapses, the control board 19 switches the air pump 17 to an air-supply state to start the stretching control processing. In the operation mode "back and hip (strong)," the control board 19 controls the air pump 17 to be in the air-supply state for 35 seconds. During this 35 seconds of the air-supply state, air is supplied to the air bag 6 to transform the stretching part 3 from the gently curved state to the strongly curved state. Here, when the stretching part 3 transforms from the gently curved state to the strongly curved state, the curvature of the stretching part 3 gradually becomes tighter as the air is supplied to the air bag 6, and muscles on the back of the user will be gradually stretched. In addition, at this time, because the user does not have to actively move one's body, the muscles on the back can be stretched in a relaxed state.

Then, after 35 seconds of an air supply state, the control board 19 controls the air pump 17 to be in a closed state for 25 seconds. During this 25 seconds of the closed state, the strongly curved state of the stretching part 3 is maintained. As a result, the back of the user is maintained in a strongly stretched state.

Then, after 25 seconds of the closed state, the control board 19 controls the air pump 17 to be in an exhaust state for 15 seconds. This exhaust state causes the air bag 6 to be in a deflated state, and the stretching part 3 returns to the gently curved state. Then, as a result, the back of the user is relieved from the strongly stretched state, and the user is in the gently stretched state on the stretching part 3.

Then, after 15 seconds of the exhaust state, the control board 19 terminates the stretching control processing by controlling the air pump 17 to be in the closed state. Then, the power supply of the control board 19 is turned OFF (on standby) upon termination of the stretching control processing.

In addition, during the stretching control processing, the control board 19 drives the vibration motor 18 to vibrate the housing 2. While the vibration of the housing 2 is damped at the stretching part 3 where the air bag 6 is disposed, the vibration will be transmitted to the stretched back via the retaining part 4*a* on which the hip is placed. By giving vibrational stimulus to the stretched back, effect of bloodstream improvement, effect of inner muscle growth, and effect of skeletal correction can be efficiently obtained.

As described above, the stretching part 3 of the stretching mat of the present embodiment is transformed from the gently curved state to the strongly curved state over time by the stretching control processing. Then, the strongly curved state is maintained for a predetermined time. Further, the body of the user is slowly stretched on the stretching part 3 in accordance with the stretching control processing. Then, when the body is maintained in the strongly stretched state for a predetermined time, an ideal stretching exercise is realized. Note that, in the above description, an example of the operation mode "back and hip (strong)" has been described, operation forms of the above-mentioned four types of stretching control processing are basically in common, differing only in the duration to be controlled in the air-supply state and the closed state. Here, in the operation mode "back and hip (strong)," the duration to be controlled in the air-supply state is set longer than that of the operation mode "back and hip (weak)" with less stretching strength. This is due to the fact that the longer the duration of the control in the air-supply state is the more air volume is supplied to the air bag 6. As a result, the air bag 6 swells largely, the curvature at the stretching part 3 in the strongly curved state becomes tight, and the body of the user is strongly stretched. In addition, in the present embodiment, the operation mode "back and hip" and the operation mode "neck" differ in the duration to be controlled in the air-supply state and the closed state. Accordingly, stretching exercise is possible at an appropriate stretching intensity for each portion of the body and at an appropriate stretched state retention time.

As described above, in the stretching mat 1 of the present embodiment, the stretching part 3 can be transformed between the gently curved state in which the stretching part 3 is gently curved and the strongly curved state in which the stretching part 3 is strongly curved by causing the air bag 6 to swell and to deflate. Accordingly, by placing the portion of the body to be stretched on the stretching part 3 in the gently curved state, and then supplying air to the air bag 6 to transform the stretching part 3 into the strongly curved state, the muscles of the body of the user can be slowly stretched in a relaxed manner. Thus, according to the stretching mat 1 of the present embodiment, the movement of slowly stretching the body and holding in that stretched state, which is a necessary movement in the stretching exercise, is made possible. This is advantageous in that high stretching effects can be obtained by the stretching mat 1 of the present embodiment.

Further, during the stretching control processing, the control board 19 executes control such that the stretching part 3 is maintained in the strongly curved state for a predetermined time and then returned to the gently curved state. This is advantageous in that the user, after strongly stretching the muscles in the strongly curved state, can take away the stretched portion from the stretching part 3 in a comfortable posture after stretching of the muscles is relaxed to some extent in the gently curved state.

In addition, in the present embodiment, because the stretching mat 1 is configured such that the stretching control processing is initiated and the air bag 6 starts swelling after 20 seconds have elapsed from a previous operation of the operation switch 5 in the operation mode selection state, there is an advantage that the user is able to place one's body on the stretching part 3 after turning on the operation switch 5 and thus eliminating the need to operate the operation switch 5 in an uncomfortable posture with one's body on the stretching part 3.

Further, in the present embodiment, during the stretching control processing, because a degree of curvature of the stretching part 3 in the strongly curved state can be varied by changing the duration of the air-supply state of the air pump 17 to adjust the supply volume of air to the air bag, there is an advantage that the user can do a stretching exercise in accordance with the portion of the body to be stretched or in accordance with stiffness of the body of the user. In addition, the stretching mat 1 of the present embodiment allows the user to stretch oneself thereon in the gently curved state if the user has stiff joints. Accordingly, the stretching mat 1 of the present embodiment can be used by a user having extremely stiff joints.

Further, the present embodiment is advantageous in that the stretching effects can be further improved by activating the vibration motor 18 during stretching control processing to transmit the vibration of the housing 2 to a user via the retaining parts 4*a*, 4*b*.

Note that the stretching mat of the present invention is not limited to the above-mentioned embodiment and may be variously modified without departing from the gist of the present invention.

For example, in the above-mentioned embodiment, the air pump 17 constitutes the air-supply means and the exhaust means according to the present invention. However, the air-supply means and the exhaust means may be realized by separate apparatuses. Further, in the above-mentioned embodiment, the air inside the air bag 6 is exhausted by actuation of the air pump 17. However, for example, the air inside the air bag 6 may be naturally exhausted therefrom due to a contraction force of the air bag 6 and the cover sheet 7 by opening an electromagnetic valve to make an interior of the air bag 6 communicate with the atmosphere.

Further, in the above-mentioned embodiment, the control board 19 is configured such that the stretching control processing is initiated when a predetermined time has elapsed after the operation of the operation switch 5. However, the control board 19 may be configured, for example, such that a pressure sensor or the like is used to detect a body placed on the stretching part 3 and the stretching control processing is initiated provided that the body is placed on the stretching part 3.

Further, in the above-mentioned embodiment, the control board 19 is configured to execute only the stretching control processing. However, the stretching mat of the present invention is not limited to one that executes only the stretching control processing. For example, in addition to the stretching control processing, such processing in which the vibration motor 18 is actuated while maintaining the stretching part 3 in the gently curved state may be executed.

DESCRIPTION OF REFERENCE NUMERALS

1/Stretching mat
2/Housing
2*a*/Upper cover
2*b*/Base body
3/Stretching part
4*a*, 4*b*/Retaining part
5/Operation switch
6/Air bag
7/Cover sheet
8/Pressure plate
9/Interior gap
13/Recessed part
14/Vent
15/Slit
17/Air pump
18/Vibration motor
19/Control board
20/Air tube
22/Air-supply/exhaust port
23/Drive shaft
24/Eccentric weight
26/Lamp
30/External power supply
31/Power supply cord

The invention claimed is:

1. A stretching mat comprising:

a housing comprising a curved upper surface having a first curvature;

an airbag disposed over the curved upper surface of the housing, the airbag comprising a first surface and a second surface;

an air supplier connected to the airbag;

an air supplier controller configured to allow the air supplier to supply air to the airbag to inflate the airbag;

a control panel for receiving a user input for controlling the air supplier controller, wherein the control panel is provided on a lateral side of the housing, wherein the air supplier controller waits a second period of time after receiving the user input and before allowing the air supplier to supply air to the airbag, wherein when the airbag is inflated, the first surface of the airbag has the first curvature and the second surface of the airbag has a second curvature, and wherein the first curvature differs from the second curvature when the airbag is inflated.

2. The stretching mat according to claim 1, wherein the second curvature has a greater degree of curvature than the first curvature.

3. The stretching mat according to claim 1, wherein the air supplier controller maintains the inflation of the airbag for a first period of time.

4. The stretching mat according to claim 3, wherein the air supplier controller releases air from the airbag after the first period of time has elapsed.

5. The stretching mat according to claim 1, further comprising a vibration device that vibrates the housing, the vibration device is disposed within the housing.

6. A stretching mat comprising:

a housing comprising a curved upper surface having a first curvature;

an airbag disposed over the curved upper surface of the housing, the airbag comprising a first surface and a second surface;

an air supplier connected to the airbag, the air supplier supplying air to the airbag to inflate the airbag; and a presser plate disposed along an entire outer peripheral of the airbag, the presser plate fixing the airbag to the curved upper surface of the housing, wherein when the airbag is deflated, the first surface and the second surface of the airbag conform to each other, wherein when the airbag is inflated, the first surface of the airbag has the first curvature and the second surface of the airbag has a second curvature, the first curvature being different from the second curvature, and wherein the presser plate comprises an opening from which the second surface of the airbag protrudes when the airbag is inflated.

* * * * *